US011376512B1

(12) United States Patent
Mayer

(10) Patent No.: US 11,376,512 B1
(45) Date of Patent: Jul. 5, 2022

(54) SWAY PLAYGROUND SWING

(71) Applicant: BCI Burke Company, LLC, Fond du Lac, WI (US)

(72) Inventor: Bart Mayer, Fond du Lac, WI (US)

(73) Assignee: BCI Burke Company, LLC, Fond du Lac, WI (US)

( * ) Notice: Subject to any disclaimer, the term of this patent is extended or adjusted under 35 U.S.C. 154(b) by 0 days.

(21) Appl. No.: 17/191,036

(22) Filed: Mar. 3, 2021

(51) Int. Cl.
*A63G 9/02* (2006.01)
*A63G 9/12* (2006.01)
*A45F 3/22* (2006.01)

(52) U.S. Cl.
CPC ..... *A63G 9/02* (2013.01); *A63G 9/12* (2013.01)

(58) Field of Classification Search
CPC .... A63G 9/00; A63G 9/02; A63G 9/12; A45F 3/22; A45F 3/24
USPC ..... 472/118, 120–125; 5/120, 121, 127, 128
See application file for complete search history.

(56) References Cited

U.S. PATENT DOCUMENTS

| | | | | |
|---|---|---|---|---|
| 3,734,494 | A | 5/1973 | Sellner | |
| 3,829,086 | A | 8/1974 | Lelong | |
| 5,729,845 | A * | 3/1998 | Hsu | A45F 3/24 5/120 |
| 6,912,744 | B2 * | 7/2005 | Lyons | A47C 3/0255 5/122 |
| 7,455,593 | B1 | 11/2008 | O'Neill | |
| D602,744 | S * | 10/2009 | Sugama | D7/591 |
| 2006/0103227 | A1 | 5/2006 | Jorg | |
| 2015/0216309 | A1 | 8/2015 | Habing | |

FOREIGN PATENT DOCUMENTS

| | | |
|---|---|---|
| CN | 110743171 | 2/2020 |
| EP | 3424573 | 1/2019 |
| KR | 100905314 | 7/2009 |

OTHER PUBLICATIONS https://funandfunction.com/sensasoft-bolster-swing.html?gclid=CjwKCAjw34n5BRA9EiwA2u9k35cEMXq5BDPGqvVcFg_OIB2li34SM6dvkfcNREXtETI9bCcAAEfYnRoC1JAQAvD_BwE.
https://funandfunction.com/soft-taco-swing.html.
https://www.overstock.com/Sports-Toys/Swing-Sets/19670/subcat.html?featuredproduct=31883262&featuredoption=58704920&kid=9553000357392&ci_src=17588969&ci_sku=36533024-000-000&cnc=US&cid=248973&type=pla&targetid=pla-120286794266&track=pspla&gclid=CjwKCAjw34n5BRA9EiwA2u9k3x9Gyme-4TyNmkl1VUpGOibmpedQ6zkVfJs-d3iZ6syLqL0AaY9yHRoC7AsQAvD_BwE.
https://www.playlsi.com/en/commercial-playground-equipment/playground-components/boogie-board/.

* cited by examiner

*Primary Examiner* — Kien T Nguyen
(74) *Attorney, Agent, or Firm* — Boyle Fredrickson S.C.

(57) ABSTRACT

A full body swing includes a broad flexible belt having a width extending between opposed front and rear ends of the swing and a length extending between opposed left and right ends of the swing, where the left and right ends are attached along their widths to an upper frame to suspend the flexible belt along a belt axis. In one embodiment, the flexible belt supports a seat section for a child to sit where movement of the seat section occurs along the belt axis of the flexible belt and is facilitated by alternating rigid and flexible sections of the belt along the belt axis.

21 Claims, 2 Drawing Sheets

SWAY PLAYGROUND SWING

BACKGROUND OF THE INVENTION

The present invention relates to playground swing sets, swings and swing gliders, and in particular, to a full body sway swing having opposite ends attached to an upper swing frame allowing for the sway swing to swing or glide along a swing axis along a lateral extension of the swing.

Generally, playground swing sets are hanging seats suspended from an upper swing frame. The seat of a swing is typically a plastic or rubber platform or support suspended from chains or ropes attached to the upper swing frame at an upper end and to opposed ends of the seat at a lower end so that the seat can swing perpendicular to the lateral extension of the swing seat in a curved arc similar to a pendulum. A glider swing is a type of swing where the hanging seat is connected at four corners of the seat to provide movement generally within a horizontal plane (without substantial upward and downward movement). The swing or glider swing can generally move in all directions within the horizontal plane of the swing.

Playground swings and glider swings are typically used with the user in a seated position on the seat with legs dangling downward from the seat to propel swinging or movement. In this respect, the child's legs are used to help produce momentum along a desired direction of travel. The child's hands may hold onto the chains or ropes of the swing to stabilize the rider.

SUMMARY OF THE INVENTION

The present invention provides a full body swing including a broad flexible belt having a width extending between opposed front and rear ends of the swing and a length extending between opposed left and right ends of the swing, where the left and right ends are attached along their widths to an upper frame to suspend the flexible belt along a belt axis. In one embodiment, the flexible belt supports a rigid seat section for a child to sit where movement of the seat section occurs along the belt axis of the flexible belt and is facilitated by alternating rigid and flexible sections of the belt along the belt axis.

The present invention may support the bodies of one or more children on the broad flexible belt. The belt may swing using forces from the child's upper body or lower body only, for example, by sitting or standing on the rigid seat section and applying a force on a spaced apart rigid force plate causing the joining flexible sections to bend along the belt axis. Side to side movement of the seat section of the swing may be along a curved line path or arc and movement of the belt may be restricted from movement in a direction perpendicular to the belt axis. In this respect, the present invention may be more safely mounted and used by one or more children, including children with disabilities, in a playground environment.

In one embodiment, the present invention may provide a swing assembly comprising a support frame extending upwardly from a ground and providing a pair of horizontally extending support bars. A belt with opposed ends is supported by the pair of horizontally extending support bars and extends below and between the pair of horizontally extending support bars along a belt axis to define a length and extending between a front and rear of the support frame to define a width, the length and width of the belt sized to be capable of supporting a child. A seat plate of a rigid material is supported by the belt and positioned between the pair of horizontally extending support bars. At least one force plate of a rigid material is supported by the belt and spaced from the seat plate and the opposed ends of the belt to provide interposed joints between the at least one force plate and the seat plate and between the at least one force plate and the opposed ends of the belt capable of being flexed along the belt axis It is thus a feature of at least one embodiment of the present invention to allow the belt to compress and expand at the flexible joints along the belt axis to promote movement or momentum of the belt along the belt axis.

The width of the belt may be at least 36 inches. The length of the belt may be at least 145 inches.

It is thus a feature of at least one embodiment of the present invention to provide a body swing sized to allow children to swing with other children or an adult, and to support the entire bodies of the riders thereon.

The opposed ends of the belt may be attached to the pair of horizontally extending support bars along an entire width of the belt. The belt may be rigid in a direction perpendicular to the belt axis. The belt may be made of a flexible rubber.

It is thus a feature of at least one embodiment of the present invention to allow children with sensory processing disorders to swing with smooth side to side motion generally along a curved line path. Therefore, motion is restricted from moving substantially upward and downward and backward and forward.

A distance between the seat plate and the at least one force plate may be at least 19 inches. A distance between the at least one force plate and the opposed ends is at least 18 inches.

It is thus a feature of at least one embodiment of the present invention to allow children with upper or lower extremity disabilities to produce movement to the swing using only their upper or lower extremities when seated. The seat plate and force plate are spaced to allow the child to reach the force plate with their arms or legs when seated.

The at least one force plate may be a first and second plates positioned laterally with respect to the seat plate.

It is thus a feature of at least one embodiment of the present invention to permit children to sit face to face and to work together to swing the belt. Therefore, the riders can engage each other during inclusive play.

The seat plate may comprise a rectangular sheet of steel. The rectangular sheet may be curved upward along the belt axis. The rectangular sheet may be attached to at least two opposed sides of an outer rectangular frame.

It is thus a feature of at least one embodiment of the present invention to create reclined seats conforming to the natural curvature of the body to provide comfortable and relaxed operation of the swing when the child is seated and their legs are extended upward.

The seat plate may further comprise first and second panels of non-slip material providing visual indication of first and second seat areas.

It is thus a feature of at least one embodiment of the present invention to quickly and intuitively indicate to the child where they should sit or stand to operate the swing.

A width of the seat plate may be substantially the same width of the belt. The seat plate may support a handlebar extending outwardly from at least one of a front end and rear end of the seat plate.

It is thus a feature of at least one embodiment of the present invention to provide broad stable support to the riders while preventing flexing of the belt at the seating area.

The at least one force plate may support an outwardly extending handle.

It is thus a feature of at least one embodiment of the present invention to permit the child to use their arms to apply a force on the force plate to swing the swing side to side.

The support frame further comprises a sunroof extending over the belt and at least partially shielding the belt from light rays directed downward from above.

It is thus a feature of at least one embodiment of the present invention to create a comfortable and cool environment where the swing can be used by children for extended amounts of time.

The present invention also provides a method of swinging on a swing assembly comprising a support frame extending upwardly from a ground and providing a pair of horizontally extending support bars, a belt with opposed ends supported by the pair of horizontally extending support bars and extending between the pair of horizontally extending support bars along a belt axis to define a length and extending below and between a front and rear of the support frame to define a width, the length and width of the belt sized to be capable of supporting a child; a seat plate of a rigid material supported by the belt and generally centered between the pair of horizontally extending support bars, and at least one force plate of a rigid material supported by the belt and spaced from the seat plate and the opposed ends of the belt by joints capable of being flexed along the belt axis. The method comprises the following steps: mounting the swing assembly to sit on the seat plate and applying a force on the at least one force plate to flex the joints along the belt axis and to create a movement of the seat plate along the belt axis.

It is thus a feature of at least one embodiment of the present invention to provide sensory development opportunities for children.

The movement of the seat plate may be substantially along a curved line path.

It is thus a feature of at least one embodiment of the present invention to provide play for children with sensory processing disorders by limiting movement.

The belt may be restricted from movement in a direction perpendicular to the belt axis.

It is thus a feature of at least one embodiment of the present invention to facilitate loading of children with disabilities onto the swing by limiting motion of the swing to one direction along a curved line path. It is also a feature of at least one embodiment of the present invention to limit the swing area to prevent accidents and allow installation of the swing in smaller playground areas.

Applying the force may be by a leg force or an arm force only on the at least one force plate.

It is thus a feature of at least one embodiment of the present invention to allow children with upper or lower disabilities to operate the swing.

These particular objects and advantages may apply to only some embodiments falling within the claims and thus do not define the scope of the invention.

DETAILED DESCRIPTION OF THE INVENTION

Figure 1:
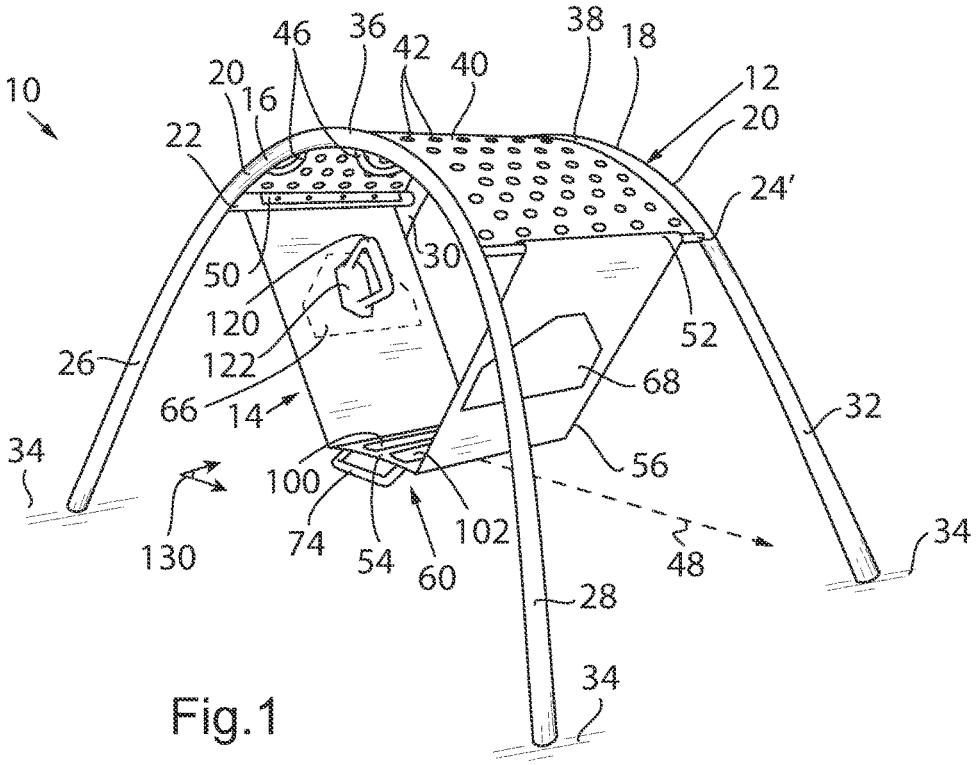
FIG. 1 is a front, right side perspective view of a flexible belt swing assembly of one embodiment of the present invention showing a flexible belt attached to and suspended from an upper frame at opposed attachment bars.

Referring to FIG. 1, a belt sway swing assembly 10 according to one embodiment of the present invention may provide a swing frame 12 supporting an attachment of a flexible sling belt 14 suspended therefrom. The swing frame 12 may comprise generally of front and rear arches 16, 18 spaced in forward and rear separation, and connected at upper curved ends 20 by a left connection bar 22 and a right connection bar 24 at left and right ends, respectively. The sling belt 14 may be hung from the left connection bar 22 and right connection bar 24 so that the sling belt 14 hangs loosely between the left connection bar 22 and right connection bar 24 and below the swing frame 12.

Each of the front and rear arches 16, 18 may be generally described as an inverted U-shaped frame. The front arch 16 may have two opposed vertically extending legs 26, 28 extending upwardly from the ground 34 and converging toward each other to a curved apex 36 of the arch 16. Similarly, the rear arch 18 may have two opposed vertically extending legs 30, 32 extending upwardly from the ground 34 and converging toward each other to a curved apex 38 of the arch 18. The upper curved ends 20 of the front and rear arches 16, 18, respectively, may extend substantially parallel.

The vertically extending legs 26, 28 of the front arch 16 and vertically extending legs 30, 32 of the rear arch 18, respectively, may be angled or splayed outwardly in a downward direction such that swing frame 12 generally widens as one moves downward from the apexes 36, 38 to the ground 34 level. The vertically extending legs 26, 28, 30, 32 may be angled at an approximately 25° downward angle with respect to vertical.

In one embodiment, the distance between the vertically extending legs 26, 28 of the front arch 16 may be about 150 to 170 inches and approximately 160 inches at the ground 34 level, and correspondingly, the distance between the vertically extending legs 30, 32 of the rear arch 18 may be about 150 to 170 inches and approximately 160 inches at the ground 34 level. The distance between the left side vertically extending legs 26 and 30 of the front arch and rear arch 18, respectively, may be about 80 to 120 inches and approximately 100 inches at the ground 34 level, and correspondingly the distance between the right side vertically extending legs 28 and 32 of the front arch and rear arch 18, respectively, may be about 80 to 120 inches and approximately 100 inches at the ground 34 level.

It is understood that in some embodiments the vertically extending legs 26, 28, 30, 32 may extend below the ground 34, for example, about 30 to 50 inches and approximately 40 inches below ground 34, to provide additional foundational support and stability to the swing frame 12. In one embodiment, the ground 34 may comprise a resilient material, e.g., grass, wood mulch, rubber mulch, wood fiber, rubber mats, pea gravel, sand, and the like, plus compacted earth backfill and concrete to stabilize the vertically extending legs 26, 28, 30, 32.

The front and rear arches 16, 18 are connected at the upper curved ends 20 by the left connection bar 22 and right connection bar 24 extending between and perpendicular to the front and rear arches 16, 18 at left and right sides, respectively. In one embodiment, the connection bars 22, 24 may be about 40 to 50 inches and approximately 46 inches in length spanning a distance between the front and rear arches 16, 18 at the upper curved ends 20.

The swing frame 12 may be manufactured of metal tubing such as galvanized steel tubing. In one embodiment, the metal tubing may have an outer diameter of about 3 to 4 inches and approximately 3.5 inches. In one embodiment, the entire swing frame 12 may be approximately 185 inches in length, 92 inches in height, and 86 inches in depth.

In one embodiment, extending over the swing frame 12 along the upper curved ends 20 of the front and rear arches 16, 18 may be a sunroof 40 providing a shield to sun rays, rain, environmental elements, and the like to an area therebelow. The sunroof 40 may extend between the left connection bar 22 and right connection bar 24, and between the front and rear arches 16, 18. The sunroof 40 may be made of a sheet material that is curved to conform to the curves of the front and rear arches 16, 18, or alternatively may be a flexible material stretched to conform to the curves of the front and rear arches 16, 18. The sunroof 40 may be made of metal, wood, plastic, canvas, or the like.

In one embodiment, the sunroof 40 is a galvanized steel sheet bent to conform to the curves of the front and rear arches 16, 18 and finished with a baked-on powder coating to protect from the environmental elements. The sunroof 40 may be attached to the swing frame 12 using fasteners attaching the sunroof 40 to the left connection bar 22 and right connection bar 24 (as seen in FIG. 2), and optionally, front and rear arches 16, 18.

In some embodiments, the sunroof 40 may contain holes 42 allowing sun rays to penetrate though the sunroof 40 and also providing a decorative effect. The design of the holes 42 may be less dense at a center of the sunroof 40 between the left connection bar 22 and right connection bar 24 where the exposure to light rays may be greater, and may be more dense at the outer edges toward the left connection bar 22 and right connection bar 24 where the light rays may be less direct or weaker. In this respect, there is more shielding from light (and other environmental elements) towards the top of the sunroof 40 where light rays would be expected to be stronger than at the edges of the sunroof 40.

In one embodiment, each of the front and rear arches 16, 18 may support a pair of downwardly extending rings 46 at the upper curved ends 20 which can be used to provide overhead grips for riding or mounting stability.

Figure 2:
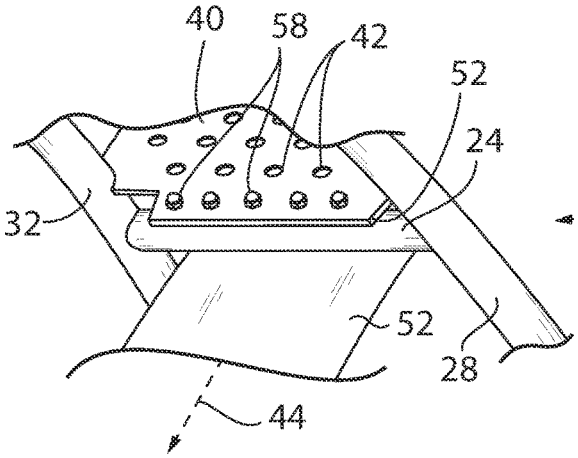
FIG. 2 is an enlarged perspective view of the attachment of the ride side of the flexible belt to the upper frame of FIG. 1 using a wrapping method.

Referring now to FIG. 2, each of the left and right connection bars 22, 24 may support opposed left and right ends 50, 52 of the flexible sling belt 14, respectively, allowing the sling belt 14 to hang downward therefrom and span between the left and right connection bars 22, 24. The opposed left and right ends 50, 52 of the sling belt 14 are separated by a length of the sling belt 14 extending along a belt axis 44 (which may be a curved axis). The sling belt 14 has a width spanning between front and rear edges 54, 56 of the sling belt 14 perpendicular to the belt axis 44. In one embodiment, the length of the sling belt 14 may be between 140 and 150 inches and at least 145 inches and approximately 145 inches and the width of the sling belt 14 may be between 30 and 40 inches and at least 36 inches and approximately 36 inches.

Referring to FIGS. 1 and 2 (showing the right end 52 of the sling belt 14 as an example), the opposed left and right ends 50, 52 of the sling belt 14 are attached to the left and right connection bars 22, 24, respectively. The opposed left and right ends 50, 52 may be attached to the left and right connection bars 22, 24 by wrapping the left and right ends 50, 52 upwardly around an outside of the left and right connection bars 22, 24. The widths of the opposed left and right ends 50, 52 of the sling belt 14 are pulled taunt along the left and right connection bars 22, 24 to remove slack, and then the entire edge is fastened to the left and right connection bars 22, 24 with fasteners, e.g., screws 58, extending through holes in the sling belt 14 and into corresponding holes extending along the length of the left and right connection bars 22, 24.

The opposed left and right ends 50, 52 of the sling belt 14 may wrap around at least 100 degrees and at least 150 degrees and at least 160 degrees around the outer circumference of the left and right connection bars 22, 24. The attachment of the entire width of the left and right ends 50, 52 of the sling belt 14 to the left and right connection bars 22, 24 allows the sling belt 14 to "pivot" about the left and right connection bars 22, 24 when the sling belt 14 swings back and forth along a swing axis 48 (the belt axis 44 extending along the swing axis 48). The left and right ends 50, 52 of the sling belt 14 are stiff along its width so that the sling belt 14 is not allowed to swing forward and backward perpendicular to the swing axis 48 as further described below.

The opposed left and right ends 50, 52 of the sling belt 14 are further secured to the left and right connection bars 22, 24 by being sandwiched between the left and right connection bars 22, 24 and the sunroof 40 which is also fastened to the left and right connection bars 22, 24 by fasteners, e.g., screws 58, extending through holes in the sunroof 40, sling belt 14, and left and right connection bars 22, 24.

The sling belt 14 is made of a flexible material that is able to extend and compress along the belt axis 44. In a preferred embodiment, the sling belt 14 is made of a flexible material that is flexible along the belt axis 44 but inflexible or rigid in a direction perpendicular to the belt axis 44. In one embodiment, the sling belt 14 may be constructed of a rubber sheet material and may be a three-ply fabric with rubber top and bottom layers. The thickness of the sling belt 14 may be about 0.25 to 1 inch and approximately 0.5 inches. The weight and thickness of the sling belt 14 may assist with stabilizing the position of the sling belt 14 below the swing frame 12.

When suspended, the length of the sling belt 14 extends between the left and right connection bars 22, 24 a distance of approximately 81 inches and the width of the sling belt 14 extends along the left and right connection bars 22, 24 a distance of approximately 36 inches. Therefore, the sling belt 14 may extend a distance that is approximately 50 to 60% of its full length to provide a slack sling belt 14. In one embodiment, the attachment of the left and right connection bars 22, 24, may cause the sling belt 14 to be suspended approximately 43 inches below the left and right connection bars 22, 24 and about 12 to 18 inches and approximately 14 inches above the ground 34.

Figure 3:
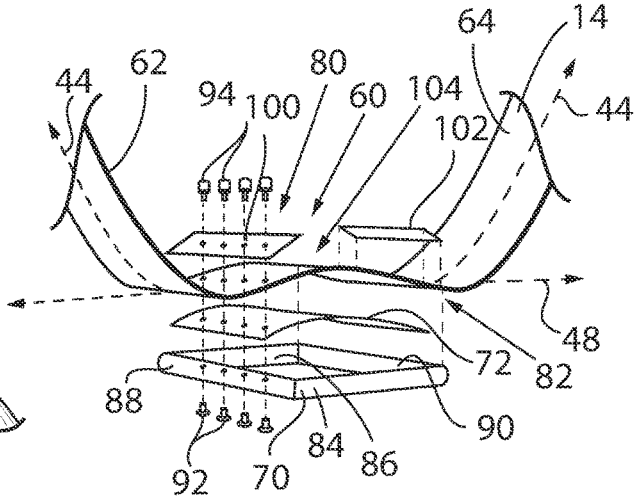
FIG. 3 is an exploded, front perspective view of the seat section of the flexible belt of FIG. 1.

Referring to FIGS. 1 and 3, the sling belt 14 includes a seat section 60 positioned toward a center of the sling belt 14 between the opposite left and right ends 50, 52 and generally falling at a lowermost position of the slung sling belt 14 due to the weight of the seat section 60. The seat section 60 may be a rigid rectangular platform or plate, for example, made of wood, metal, plastic, or the like. The seat section 60 may span substantially the width of the sling belt 14 and along a desired length of the sling belt 14 in order to accommodate a body of a child sitting on the seat section 60. The seat section 60 may have a length between 20 and 30 inches and approximately 22 inches and a width between 30 and 40 inches and approximately 36 inches.

In one embodiment, the seat section 60 may be made rigid using the construction of multiple combined seat parts affixed to an upper surface 80 and lower surface 82 of the sling belt 14 as further described below.

The seat section 60 may include a seat frame 70 providing a rigid, outer rectangular frame with front and rear bars 84, 86 defining a length of the seat frame 70 and left and right bars 88, 90 attached to the front and rear bars 84, 86 at left and right ends, respectively, defining a width of the seat frame 70. The seat frame 70 may be constructed of tube material, for example, galvanized steel tubing with an embossed exterior surface providing a non-stick surface and having an outer diameter of 1 to 1.5 inches and approximately 1.3 inches. The seat frame 70 may have a length between 15 and 20 inches and approximately 19 inches and a width between 40 and 45 inches and approximately 43 inches.

The seat frame 70 may support thereon a plate 72 being a rectangular sheet material extending substantially over the seat frame 70. The width of the plate 72 may be slightly shorter than the width of the seat frame 70 to allow the seat frame 70 to protrude from the plate 72 to provide a handlebar 74 for gripping the front and rear ends of the seat frame 70 as further described below. The plate 72 may have a length between 15 and 20 inches and approximately 19 inches and a width between 40 and 45 inches and approximately 36 inches.

The plate 72 may be attached to the seat frame 70 primarily along the left and right bars 88, 90 of the seat frame 70 by fasteners causing the plate 72 to bend or arch upward along the swing axis 48. Therefore, the width of the arch between its two legs, is defined by the length of the seat frame 70 along the swing axis 48. The plate 72 may be made of a flexible sheet material (e.g., galvanized steel finished with a baked-on powder coating) that allows the plate 72 to arch upward without breaking. The radius of curvature of the arch may be between 30 and 40 inches and approximately 34 inches.

The seat frame 70 and plate 72 are affixed to a lower surface 82 of the sling belt 14 by fasteners, e.g., screws 92, extending upwardly through holes of the seat frame 70, upwardly arching plate 72, and sling belt 14 which are secured at an upper end by barrel nuts 94 receiving the screws 92 therein. The upward arch of the plate 72 translates to the flexible sling belt 14 to bend the flexible sling belt 14 upwardly to provide an upward arch to the sling belt 14.

The handlebar 74 created by the seat frame 70 may jut outward from the front and rear edges 54, 56 of the sling belt 14. The handlebar 74 has an embossed exterior surface for increasing the friction grip of the handlebar 74. This handlebar 74 can be used to stabilize the sling belt 14 when children are mounting the seat section 60.

An upper surface 80 of the sling belt 14 may further support first and second seat panels 100, 102 providing a pair of rectangular plates indicating a designated area of the seat section 60 where the child should sit or stand. The first and second seat panels 100, 102 are separately attached to the sling belt 14 primarily affixed along the left and right bars 88, 90, respectively, of the seat frame 70 and separated by a gap 104 therebetween. The seat panels 100, 102 provide visual indications of sitting or standing areas of the seat section 60 and may be, for example, a different color from the sling belt 14. The first and second seat panels 100, 102 may be a polymer plate such as made from high-density polyethylene (HDPE) and may be made of a non-slip or rough material for improving grip. In one embodiment, the first and second seat panels 100 may be 5 to 10 inches and approximately 6 inches in length and 35 to 40 inches and approximately 36 inches in width. The gap 104 between the panels may be 10 to 15 inches and approximately 10 inches in length and 35 to 40 and approximately 36 inches in width.

The first and second seat panels 100, 102 may be attached to the upper surface 80 by the same screws 92 extending upwardly through the holes of the seat frame 70, plate 72, and sling belt 14, and through corresponding holes of the first and second seat panels 100, 102 which are secured at an upper end by barrel nuts 94 receiving the screws 92 therein. It is understood that the barrel nuts 94 may provide a flush upper surface of the first and second seat panels 100, 102. It is also understood that additional fasteners may be used to attach the inner edges of the first and second seat panels 100, 102 to the upper surface 80 of the sling belt 14 than those extending though the left and right bars 88, 90.

Figure 4:
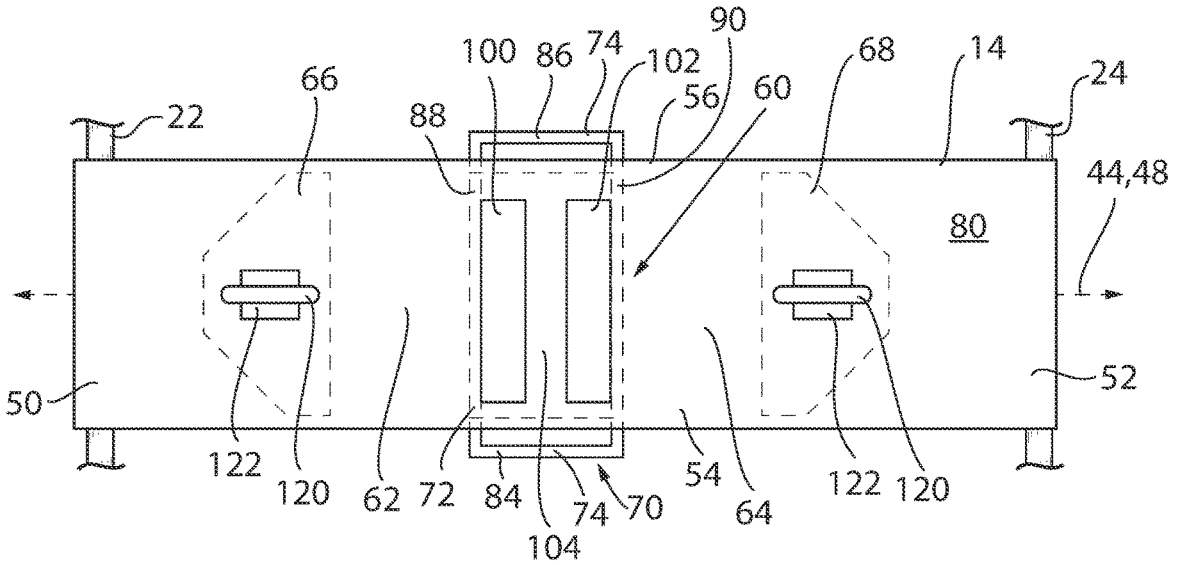
FIG. 4 is a schematic elevation view of the flexible belt of FIG. 1 taken from above showing a seat section supported by the flexible belt and flanked by left and right rigid force plates with flexible joints therebetween.

Referring to FIGS. 1 and 4, the seat section 60 may be flanked by left and right flexible joint sections 62, 64, for example, formed by the flexible sling belt 14, and further joining the rigid seat section 60 to left and right rigid plates 66, 68 at outer left and right sides of the flexible joint sections 62, 64. The left and right flexible joint sections 62, 64 are capable of being flexed, expanded and compressed along the swing axis 48. The flexible joint sections 62, 64 may span a length between 15 to 20 inches and approximately 19 inches and a width of 35 to 40 inches and approximately 36 inches between the seat section 60 and the left and right plates 66, 68.

The left and right rigid plates 66, 68 may be rectangular or polygonal in shape. In one embodiment, the left and right plates 66, 68 may be generally pentagonal or house shaped. The left and right plates 66, 68 may be attached to a lower surface 82 of the sling belt 14 by fasteners, e.g., screws extending through holes of the left and right plates 66, 68 and through corresponding holes of the sling belt 14. The left and right plates 66, 68 may be made of a rigid polymer material such as high-density polyethylene (HDPE). The left and right plates 66, 68 may be rigid plates extending substantially the full width of the sling belt 14 and 15 to 20 inches and approximately 18 inches in length and 35 to 40 inches and approximately 36 inches in width.

Referring again to FIG. 1, an opposed upper surface 80 of the sling belt 14, opposite the left and right plates 66, 68, may support handles 120 defined by a curved bar extending along the length of the sling belt 14 to form a loop for gripping by the hand of the user. The handles 120 may be generally centered between the front and rear edges 54, 56 of the sling belt 14. In one embodiment, the handles 120 may be a galvanized steel tubing with an embossed exterior surface to improve grip and having an outer diameter between about 1 to 1.5 inches and approximately 1.3 inches, and a curved or bent length of about 10 to 15 inches and approximately 14 inches.

The handles 120 may be attached to the upper surface 80 of the sling belt 14 opposite the left and right plates 66, 68 by fasteners, e.g., screws extending through holes of a base plate 122 of the handle 120, the sling belt 14, and the left and right plates 66, 68. Therefore, the handle 120 may be supported by the left and right plates 66, 68. The handle 120 allows a sitting or standing child to grip the handle 120 when swinging on the sling belt 14. It is understood that the sling belt 14 is wide enough so that a child that is sitting or standing on or in the seat section 60 may be positioned on either side of the handle 120 when sitting.

Figure 5:
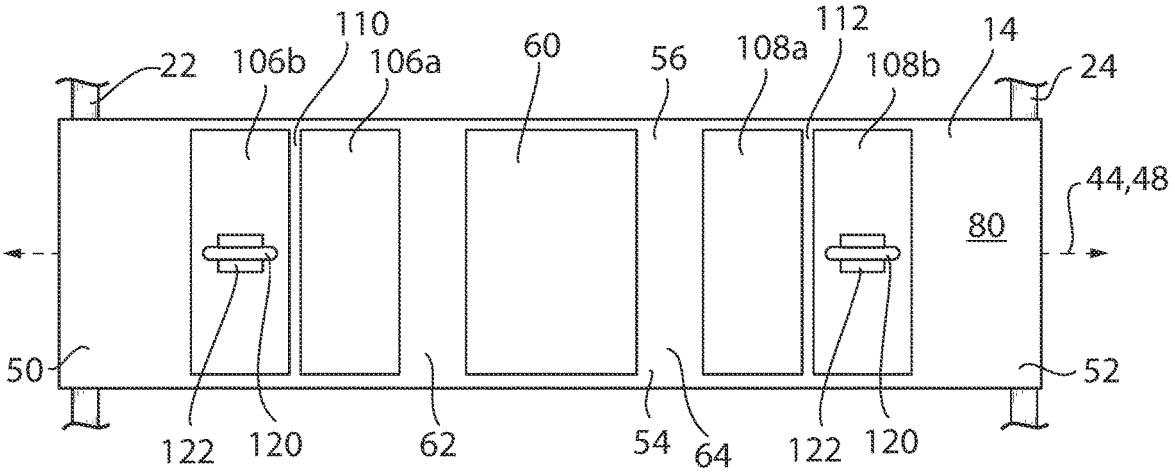
FIG. 5 is a schematic elevation view of an alternative embodiment of the flexible belt of the flexible belt swing assembly of FIG. 1 showing a seat section supported by the flexible belt and flanked by alternating pairs of left and right rigid plates with flexible joints therebetween.

Referring to FIG. 5, in an alternative embodiment of the present invention, left and right plates 66, 68 may be replaced by a pair of left side plates 106*a*, 106*b* and a pair of right-side plates 108*a*, 108*b*, respectively. The pair of left side plates 106*a*, 106*b* are separated by a narrow flexible section 110, for example, formed by the sling belt 14, and which span a length of 1 to 3 inches and approximately 2 inches and a width of 35 to 40 inches and approximately 36 inches between the pair of left side plates 106*a*, 106*b*. Similarly, the pair of right-side plates 108*a*, 108*b* are separated by a narrow flexible section 112, for example, formed by the sling belt 14, and which span a length between 1 and 3 inches and approximately 2 inches and a width between 35 and 40 inches and approximately 36 inches between the pair of plates 106*a*, 106*b*. The handles 120 of this alternative embodiment may be supported by the outer plates 106*b*, 108*b*.

It is understood that in an alternative embodiment of the present invention, the sling belt 14 may be discontinuous flexible joint sections joined by interposed rigid plates instead of being a continuous belt material with rigid plates attached thereto as shown in the figures. In this respect, the rigid seat section 60 and rigid left and right plates 66, 68 may be joined by separate flexible joints sections 62, 64 of flexible material, and the rigid left and right plates 66, 68 may be joined to the left and right connection bars 22, 24 by separate left and right ends 50, 52 of flexible material.

Referring now to FIGS. 1 and 4, it is contemplated that the belt sway swing assembly 10 may be ridden be one or more children in the following described manner.

In one embodiment, a first child may be seated with the child's bottom on the first seat panel 100 with the child's back resting upon the rigid left plate 66 nearest the first seat panel 100. The child's legs may extend across the seat section 60 (and across the second seat panel 102) so that the child's feet contact the rigid right plate 68. In this respect, the seated child will use their legs and feet to push off the rigid right plate 68 and release to create a momentum causing the sling belt 14 to move along the swing axis 48. The left and right flexible joint sections 62, 64 of the sling belt 14 allow the rigid right plate 68 to move with respect to the first seat panels 100 to provide movement of the first seat panel 100 side to side along the swing axis 48. In this respect, the child may produce movement of the sling belt 14 through their legs only.

A second child may be seated in the opposite direction, facing the first child to allow face to face interaction, with the second child seated with the child's bottom on the second seat panel 102 with the child's back resting upon the rigid right plate 68 nearest the second seat panel 102. The child's legs may extend across the seat section 60 (and across the first seat panel 100) so that the child's feet contact the rigid left plate 66. In a similar manner, the seated child will use their legs and feet to push off the rigid left plate 66 and release to create a momentum causing the sling belt 14 to move along the swing axis 48. The left and right flexible joint sections 62, 64 of the sling belt 14 allow the rigid left plate 66 to move with respect to the second seat panel 102 to provide movement of the second seat panel 102 side to side along the swing axis 48. In this respect, the child may produce movement of the sling belt 14 through their legs only.

In an alternative embodiment, a child may position their entire body within the seat section 60 with the child's bottom on the seat section 60 and their legs within the seat section 60. The child may use their left and right arms to push and pull the rigid left and right plates 66, 68, with the assistance of the handles 120, to create a momentum causing the sling belt 14 to move along the swing axis 48. In this respect, the child may produce movement of the sling belt 14 through their arms only.

In an alternative embodiment, a first child may stand on the first seat panel 100 with the child's back resting upon the rigid left plate 66 nearest the first seat panel 100. The child may use the handle 120 to push and pull the rigid left plate 66 to create a momentum causing the sling belt 14 to move along the swing axis 48. A second child may stand on the second seat panel 102 with the child's back resting upon the rigid right plate 68 nearest the second seat panel 100. The child may use the handle 120 to push and pull the rigid right plate 68 to create a momentum causing the sling belt 14 to move along the swing axis 48.

It is understood that the seat section 60 is primarily held in a horizontal plane 130 of the seat section 60 and the seat section 60 moves side to side along the swing axis 48 and slightly upward and downward along a circular curved line path consistent with a lower part of the belt axis 44 with a large radius and low degree of curvature. The radius and degree of curvature of the curved path may be between 50 and 60 inches and approximately 55 inches. The seat section 60 does not move backward and forward in directions perpendicular to the swing axis 48 thus making mounting of the seat section 60 less difficult and restricting movement of the sling belt 14 to a single direction of travel for safety.

It is understood that the preferred movement of the sling belt 14 is made possible by the alternating rigid 60, 66, 68 and flexible 62, 64, 50, 52 sections of the sling belt 14 along the swing axis 48. The restricted movement of the sling belt 14 is made possible by the stiff material of the sling belt 14 along its width attached to the left connection bar 22 and right connection bar 24.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What I claim is:

1. A swing assembly comprising:

a support frame extending upwardly from a ground and providing a pair of horizontally extending support bars;

a belt with opposed ends supported by the pair of horizontally extending support bars and extending below and between the pair of horizontally extending support bars along a belt axis to define a length and extending between a front and rear of the support frame to define a width, the length and width of the belt sized to be capable of supporting a child;

a seat plate of a rigid material supported by the belt and positioned between the pair of horizontally extending support bars; and at least one force plate of a rigid material supported by the belt and spaced from the seat plate and the opposed ends of the belt to provide interposed joints between the at least one force plate and the seat plate and between the at least one force plate and the opposed ends of the belt capable of being flexed along the belt axis.

2. The swing assembly of claim 1 wherein the width of the belt is at least 36 inches and the length of the belt is at least 145 inches.

3. The swing assembly of claim 1 wherein the opposed ends of the belt are attached to the pair of horizontally extending support bars along an entire width of the belt.

4. The swing assembly of claim 1 wherein the belt is substantially rigid in a direction perpendicular to the belt axis.

5. The swing assembly of claim 4 wherein the belt is made of rubber flexible in at least one direction.

6. The swing assembly of claim 1 wherein a distance between the seat plate and the at least one force plate is at least 19 inches.

7. The swing assembly of claim 1 wherein a distance between the at least one force plate and the opposed ends is at least 18 inches.

8. The swing assembly of claim 1 wherein the at least one force plate is a first and second plate positioned laterally with respect to the seat plate.

9. The swing assembly of claim 1 wherein the seat plate comprises a rectangular sheet curved upward along the belt axis.

10. The swing assembly of claim 9 wherein the seat plate comprises the rectangular sheet attached to at least two opposed sides of an outer rectangular frame.

11. The swing assembly of claim 10 wherein the rectangular sheet is a rectangular sheet of steel.

12. The swing assembly of claim 1 wherein the seat plate comprises first and second panels of non-slip material providing visual indication of first and second seat areas.

13. The swing assembly of claim 1 wherein a width of the seat plate is substantially a same width of the belt.

14. The swing assembly of claim 13 wherein the seat plate supports a handlebar extending outwardly from at least one of a front end and rear end of the seat plate.

15. The swing assembly of claim 1 wherein the at least one force plate supports an outwardly extending handle.

16. The swing assembly of claim 1 wherein the support frame further comprises a sunroof extending over the belt and at least partially shielding the belt from light rays directed downward from above.

17. A method of swinging on a swing assembly by a user, the swing assembly comprising a support frame extending upwardly from a ground and providing a pair of horizontally extending support bars, a belt with opposed ends supported by the pair of horizontally extending support bars and extending between the pair of horizontally extending support bars along a belt axis to define a length and extending below and between a front and rear of the support frame to define a width, the length and width of the belt sized to be capable of supporting the user, a seat plate of a rigid material supported by the belt and positioned between the pair of horizontally extending support bars, and at least one force plate of a rigid material supported by the belt and spaced from the seat plate and the opposed ends of the belt by joints capable of being flexed along the belt axis, the method comprising the steps of:

mounting of the swing assembly by the user to sit on the seat plate; and applying a force on the at least one force plate by the user to flex the joints along the belt axis and to create a movement of the seat plate substantially along the belt axis.

18. The method of claim 17 wherein the movement of the seat plate is substantially along a curved path.

19. The method of claim 17 wherein applying the force on the at least one force plate of the belt is substantially restricted from movement in a direction perpendicular to the belt axis.

20. The method of claim 17 wherein applying the force is by a leg force of the user on the at least one force plate.

21. The method of claim 17 wherein applying the force is by an arm force of the user on the at least one force plate.

* * * * *